US007192261B2

(12) United States Patent
Tsuchiya et al.

(10) Patent No.: US 7,192,261 B2
(45) Date of Patent: Mar. 20, 2007

(54) SCROLL FLUID MACHINE HAVING PERMANENT MAGNETS MOUNTED ON RESPECTIVE THE STATIONARY AND ORBITING END PLATES FOR PREVENTING AXIAL MOTION OF THE ORBITING SCROLL

(75) Inventors: Masaru Tsuchiya, Yokohama (JP); Masatomo Tanuma, Yokohama (JP); Ryusuke Muto, Yokohama (JP); Yuki Takada, Yokohama (JP)

(73) Assignee: Anest Iwata Corporation (JP)

( * ) Notice: Subject to any disclaimer, the term of this patent is extended or adjusted under 35 U.S.C. 154(b) by 5 days.

(21) Appl. No.: 11/133,565

(22) Filed: May 20, 2005

(65) Prior Publication Data

US 2005/0265879 A1 Dec. 1, 2005

(30) Foreign Application Priority Data

Jun. 1, 2004 (JP) ..... 2004-163197

(51) Int. Cl.
*F03C 2/00* (2006.01)
*F04C 18/00* (2006.01)

(52) U.S. Cl. ..... 418/55.5; 418/55.1; 418/57; 417/356

(58) Field of Classification Search ..... 418/55.1–55.6, 418/57; 417/356, 310
See application file for complete search history.

(56) References Cited

FOREIGN PATENT DOCUMENTS

| | | | | |
|---|---|---|---|---|
| JP | 01310190 A | * | 12/1989 | ..... 417/356 |
| JP | 04203486 A | * | 7/1992 | |
| JP | 09329093 A | * | 12/1997 | |
| JP | 2002188584 A | * | 7/2002 | |
| JP | 2003021084 A | * | 1/2003 | |

* cited by examiner

*Primary Examiner*—Theresa Trieu

(57) ABSTRACT

In a scroll fluid machine, an orbiting scroll is eccentrically revolved with respect to a stationary scroll so that fluid in a sealed chamber between the stationary and orbiting scrolls may be compressed toward a center. A first magnet is mounted on the stationary scroll and a second magnet is mounted on the orbiting scroll so that the same poles of the first and second scrolls may be opposite to each other thereby preventing the orbiting scroll from pressing the stationary scroll excessively.

8 Claims, 4 Drawing Sheets

PRIOR ART

SCROLL FLUID MACHINE HAVING PERMANENT MAGNETS MOUNTED ON RESPECTIVE THE STATIONARY AND ORBITING END PLATES FOR PREVENTING AXIAL MOTION OF THE ORBITING SCROLL

BACKGROUND OF THE INVENTION

The present invention relates to a scroll fluid machine and especially to a scroll fluid machine in which a stationary wrap of a stationary scroll engages with an orbiting wrap of an orbiting scroll which is eccentrically revolved by an eccentric shaft so that a gas absorbed through the outer circumference is compressed toward the center.

A scroll fluid machine includes a scroll compressor, a scroll vacuum pump, a scroll expander and a scroll blower.

FIG. 3 shows a scroll decompressor for decompressing a separate chamber connected therewith, as one example of a scroll fluid machine, and the left and right sides are deemed to be the front and rear.

A stationary scroll 1 at the front or left side in FIG. 3 comprises a stationary end plate 4 which has an inlet 2 in the outer circumference and an outlet 3 at the center. The stationary end plate 8 has a spiral stationary wrap 5 on the front surface and a plurality of horizontal corrugated cooling fins 6 provided at regular intervals on the rear surface.

An orbiting scroll 7 behind the stationary scroll 1 comprises a circular orbiting end plate 8 which has a spiral orbiting wrap 9 on the front surface opposite to the stationary scroll 1 and a plurality of corrugated cooling fins 10 provided horizontally at regular intervals on the rear surface.

A bearing plate 11 is provided on the rear surface of the orbiting scroll 7. On the center of the rear surface of the bearing plate 11, there is a tubular boss 15 which rotatably supports an eccentric axial portion 13 of a drive shaft 12 via a roller bearing 14 and an oil seal 15*a*. At three points of the outer circumference of the bearing plate 11, there are known crank-pin-shaped self-rotation preventing mechanisms 16 so that the orbiting scroll 7 may eccentrically be revolved around the drive shaft 12 in a housing 17.

The rear end of the drive shaft 12 projects from the housing 17 and a power-transmitting pulley 18 and a cooling fan 19 are mounted to the rear end. The cooling fan 19 is covered with a cover 20 mounted to the rear surface of the housing 17.

A cover plate 21 is fixed on the front surface of the stationary scroll 1 by a screw 22. The orbiting scroll 7 and the bearing plate 11 are fixed by a screw 23. The rear plate 24 of the stationary scroll 1 is fixed on the housing 17 by a bolt 25 and a nut 26.

Engagement grooves 5*a*,9*a* are formed on the stationary wrap 5 and the orbiting wrap 9 respectively. Seal members "S" are put in the engagement grooves 5*a*,9*a* and are in sliding contact with the orbiting end plate 8 of the orbiting scroll 7 and the stationary end plate 4 of the stationary scroll 1.

The orbiting scroll 7 is eccentrically revolved with the eccentric axial portion 13 of the drive shaft 12 and the self-rotation preventing mechanisms 16 so that the volume of a spiral sealed chamber between the stationary wrap 5 and the orbiting wrap 9 may reduce gradually toward the center thereby introducing fluid absorbed through the outer circumference to the center to discharge it through the outlet 3.

In the scroll fluid machine, the orbiting scroll 7 is subjected to thrust during operation owing to pressure difference between the front and rear surfaces. Thrust is directed in a certain or forward direction.

As shown in FIG. 4, there is a scroll fluid machine in which two stationary scrolls 1,1 are provided opposite to each other and an orbiting scroll 7 having orbiting wrap 9,9 on the front and rear surfaces respectively. The scroll fluid machine is subjected to such thrust as well. It is inevitable owing to pressure difference which often occurs in front of and behind of the orbiting scroll 7 during operation.

Such thrust acts to the orbiting scroll, so that excessive force acts to the seal members "S" at the ends of the stationary and orbiting wraps. Thus, rotation resistance of the orbiting scroll 7 increases and the seal members "S" are worn and deformed, so that the end of the orbiting wrap 9 directly contacts the stationary end plate 4 to make its original function lost.

To solve the disadvantages, JP 9-329093A, JP 2002-188584A and JP 2003-21084A disclose that the same pole magnets are disposed on opposite surfaces of stationary and orbiting scrolls to keep the orbiting scroll in position by its repulsive force.

JP 9-329093A discloses an annular magnet or a plurality of small magnets arranged annularly on the rear surface of an orbiting scroll which is opposite to a thrust bearing thereby preventing a gap in a sliding surface between the orbiting scroll and the thrust bearing. However, it is not intended to prevent axial motion of the orbiting scroll and such advantage is not achieved.

JP 2002-188584A discloses magnets which are provided in a stationary member and an orbiting scroll respectively to constitute a self-rotation preventing mechanism for preventing self-rotation of the orbiting scroll by magnetic force which acts between the magnet of the stationary member and the magnet of the orbiting scroll. However axial motion of the orbiting scroll is not prevented.

JP 2003-21084A discloses a permanent magnet as supplemental energizing means for generating axial force for pressing an orbiting scroll axially toward a stationary scroll thereby reducing thrust which acts to a sliding contact surface which supports an orbiting scroll axially by a middle housing. However, it is not intended to decrease mutual pressing force between the stationary and orbiting scrolls.

SUMMARY OF THE INVENTION

To overcome the disadvantages in the prior art, it is an object of the present invention to provide a scroll fluid machine to allow axial distance between a stationary scroll and an orbiting scroll to be kept suitably by repulsive force of magnets.

BRIEF DESCRIPTION OF THE DRAWINGS

The features and advantages of the invention will become more apparent from the following description with respect to an embodiment as shown in appended drawings wherein.

DETAILED DESCRIPTION OF PREFERRED EMBODIMENTS

Figure 1:
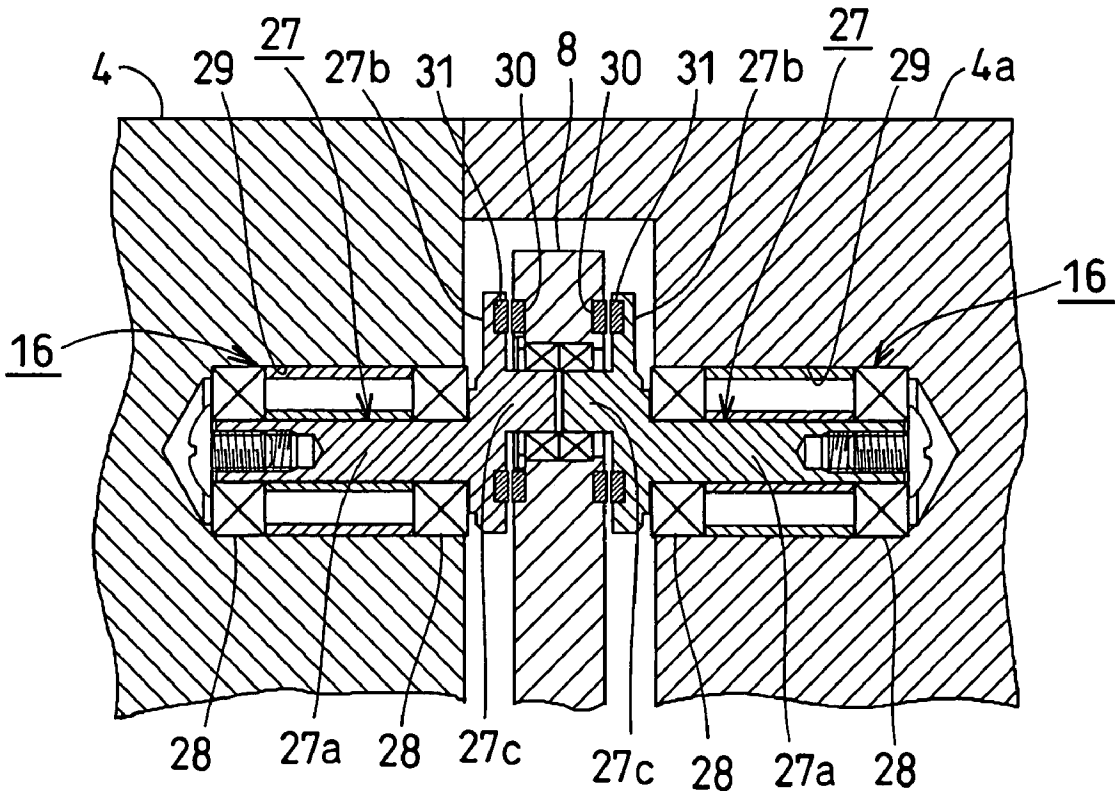
FIG. 1 is a vertical sectional side view of an embodiment, of a scroll fluid machine according to the present invention.

FIG. 1 shows a preferred embodiment of a scroll fluid machine according to the present invention. Stationary end plates 4,4*a* are provided on a stationary scroll fixed to a housing (not shown) and a cover plate (not shown). Self-rotation preventing mechanisms 16,16 are axially provided on the outer circumference of the stationary end plate 4*a*.

A main shaft 27*a* of pin-crank 27 in the self-rotation preventing mechanism 16 is engaged in a hole 29 of the stationary end plate 4*a* via ball bearings 28,28. An eccentric shaft 27*c* of the pin-crank 27 is projected from a larger-diameter shell 27*b* of the main shaft 27*a* and engaged on the front and rear surfaces of an orbiting end plate 8. The larger-diameter shell 27*b* is located between the stationary end plate 4,4*a* and the orbiting end plate 8.

On the opposing surfaces of the orbiting end plate 8 and the larger-diameter shell 27*b*, permanent magnets 30,31 are embedded while the same poles are opposite to each other. The permanent magnets 30 and/or 31 may comprise a ring or a plurality of small rings so far as the same poles are opposite to each other.

Even if thrust is axially applied to the orbiting end plate 8 during operation, the orbiting end plate 8 is always kept against the stationary end plate 4,4*a* at a proper distance thereby preventing seal members at the end of stationary or orbiting wrap from pressing the other excessively, so that wear or abnormal resistance does not occur.

Figure 2:
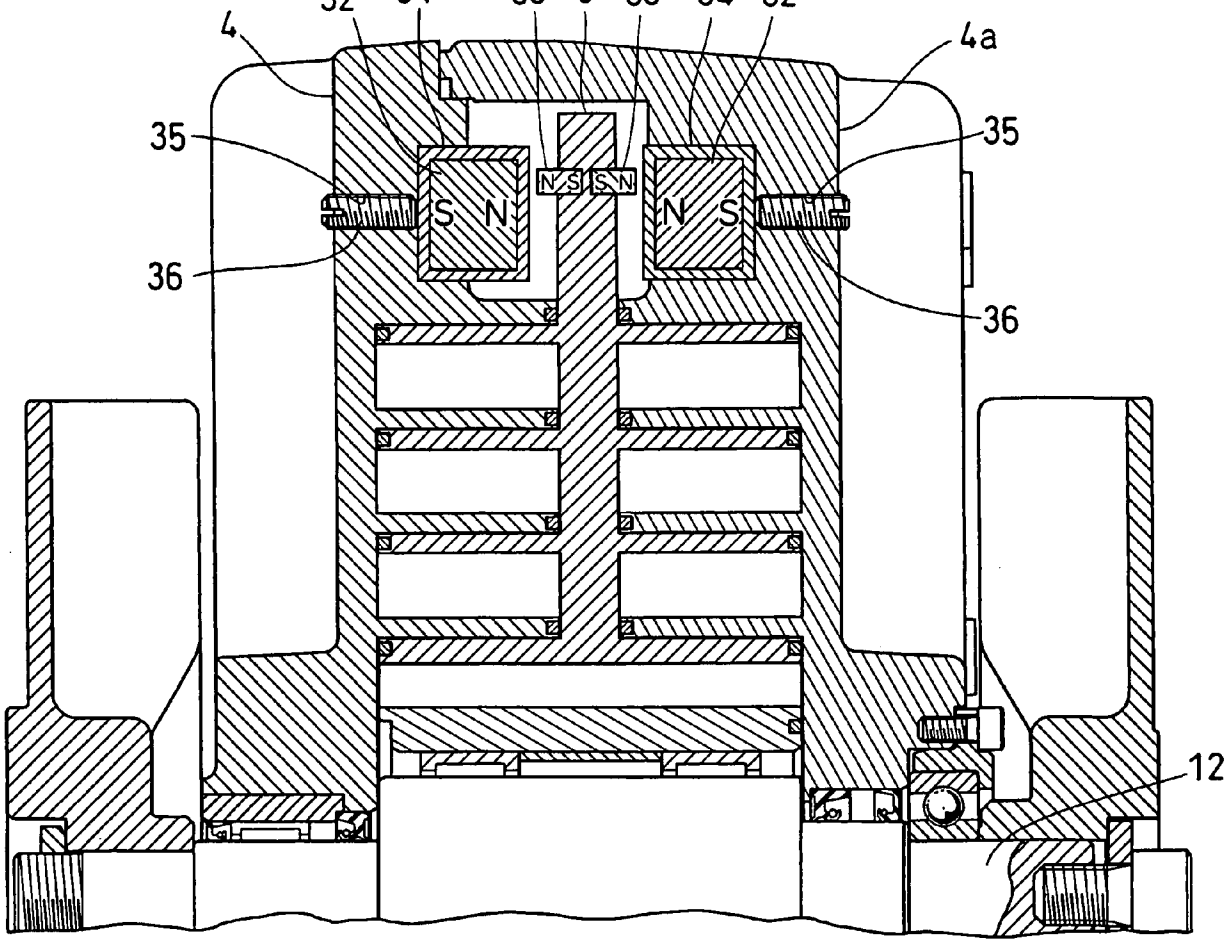
FIG. 2 is a vertical sectional side view at the other side of the scroll fluid machine.
Figure 3:
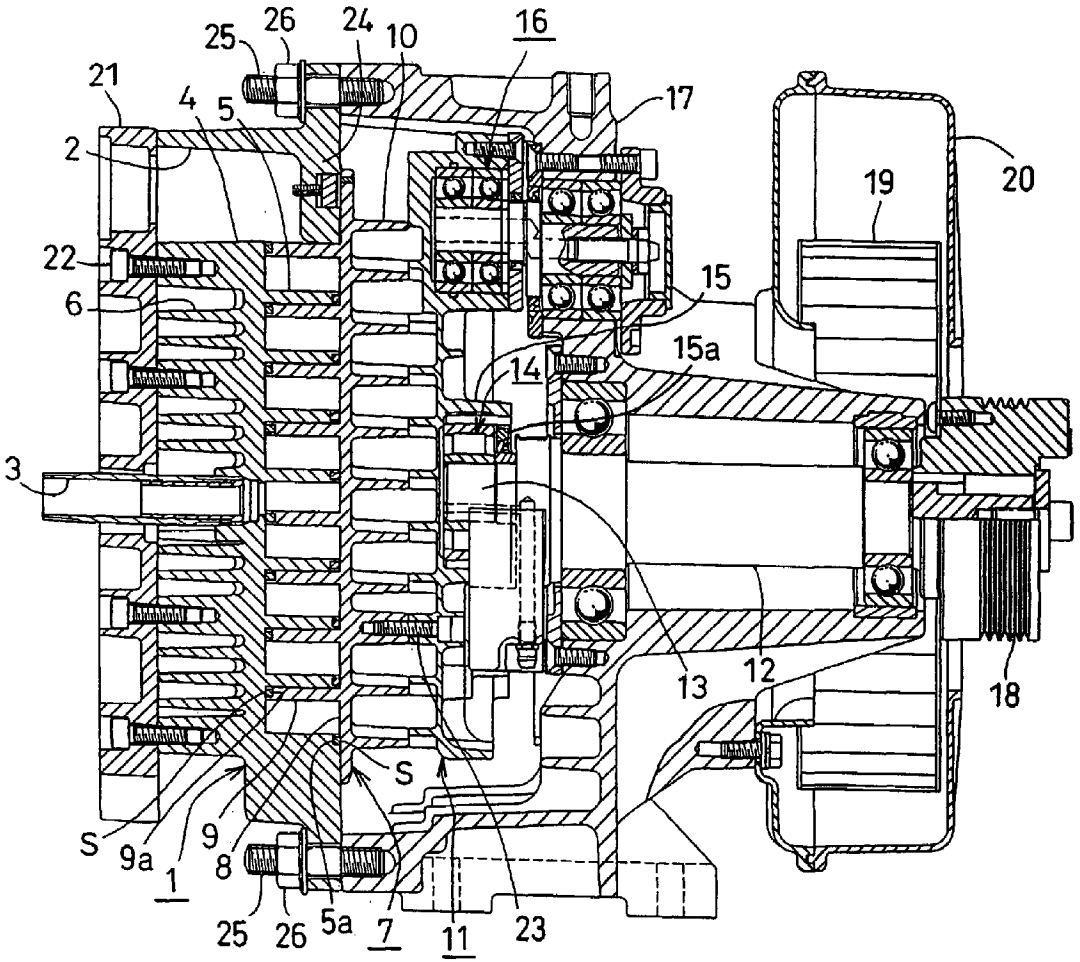
PRIOR ART FIG.3
FIG. 3 is a vertical sectional side view of a general scroll fluid machine.
Figure 4:
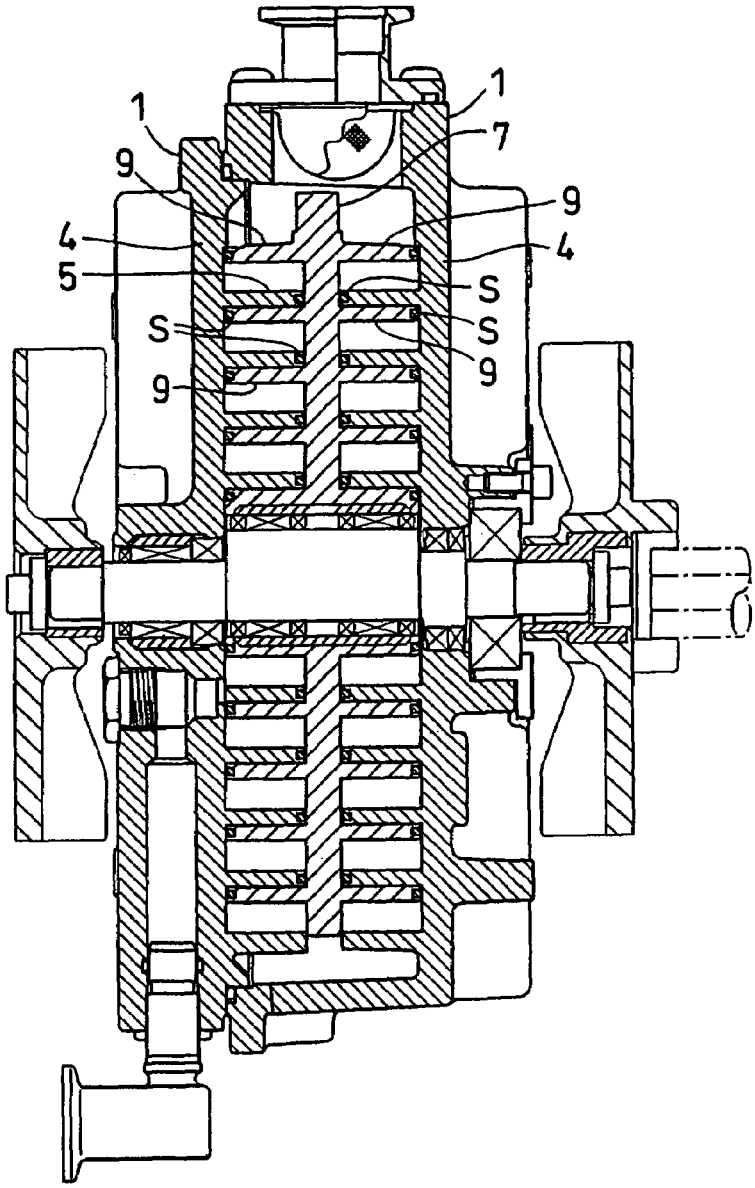
FIG. 4 is a vertical sectional side view of another general scroll fluid machine.

FIG. 2 shows the other side of the stationary end plates 4,4*a* and the orbiting end plate 5*a* which has no pin-crank-type self-rotation preventing mechanism. Slightly larger permanent magnets 32 have the same poles on the inner surfaces of the stationary end plates 4,4*a*, and smaller permanent magnets 33 have the same poles as those of the inner surfaces of the larger permanent magnets 32.

The orbiting end plate is eccentrically revolved with respect to the stationary scroll around a drive shaft 12. Whatever rotation angle the orbiting end plate 8 has, the larger permanent magnet 32 and the smaller permanent magnet 33 are determined in size and location such that they are kept in opposite relationship without radial deviation.

The whole circumferential surfaces of the permanent magnets 32,33 are both coated with a corrosion resistant non-magnetic cover 34 made of Al, stainless steel or synthetic resin.

At the center of the larger permanent magnet 32 in the stationary end plate 4,4*a*, a threaded bore 35 is bored and the inner end of a screw 36 in the bore 35 is allowed to contact the outer end of the larger permanent magnet 32.

The permanent magnets 32,32 may be screwed in the stationary end plate 4,4*a* to adjust axial location.

The foregoing merely relates an embodiment of the present invention. Various changes and modifications may be made by a person skilled in the art without departing from the scope of claims wherein:

What is claimed is:

1. A scroll fluid machine comprising:

a drive shaft having an eccentric axial portion at one end;

a stationary scroll comprising a stationary end plate having a stationary wrap;

an orbiting scroll comprising an orbiting end plate having an orbiting wrap, the orbiting scroll being rotatably mounted around the eccentric axial portion of the drive shaft, the orbiting scroll being eccentrically revolved with respect to the stationary scroll by the drive shaft so that fluid in a sealed chamber between the stationary and orbiting wraps may be compressed toward a center;

a self-rotation preventing mechanism for preventing the orbiting scroll from rotating its own axis, said mechanism being provided near an outer circumference of the stationary scroll;

a first permanent magnet provided on the stationary end plate; and a second permanent magnet provided on the orbiting end plate so that the same poles of the first and second permanent magnets are opposite to each other thereby preventing the orbiting scroll to press the stationary scroll excessively.

2. A scroll fluid machine as claimed in claim 1 wherein the same poles of the first and second permanent magnets are opposite to each other in the self-rotation preventing mechanism.

3. A scroll fluid machine as claimed in claim 1 wherein the self-rotation preventing mechanism comprises a main shaft, an eccentric shaft and a larger-diameter shell between the stationary and orbiting scrolls, the first permanent magnet being provided on the larger-diameter shell, the second permanent magnet being provided on the orbiting scroll, the same poles of the first and second magnets being opposite to each other.

4. A scroll fluid machine as claimed in claim 1 wherein one of the first and second permanent magnets is annular, the permanent magnet being within region of the annular magnet even if the orbiting scroll is eccentrically revolved with respect to the stationary scroll.

5. A scroll fluid machine as claimed in claim 1 wherein the first and second permanent magnets are enclosed with a non-magnetic cover.

6. A scroll fluid machine as claimed in claim 1 wherein the first and second permanent magnets are covered with a corrosion resistant cover.

7. A scroll fluid machine as claimed in claim 1 wherein a cover of the first permanent magnet is engaged with a screw to allow axial position of the magnet to be kept suitably.

8. A scroll fluid machine as claimed in claim 1 wherein the magnets are screwed so that axial position of the magnets may be adjusted.

* * * * *